US008570836B2

(12) United States Patent
Hama

(10) Patent No.: US 8,570,836 B2
(45) Date of Patent: Oct. 29, 2013

(54) ACOUSTIC TRANSDUCER

(75) Inventor: Yoshinori Hama, Tokyo (JP)

(73) Assignee: NEC Corporation, Tokyo (JP)

( * ) Notice: Subject to any disclaimer, the term of this patent is extended or adjusted under 35 U.S.C. 154(b) by 315 days.

(21) Appl. No.: 13/103,908

(22) Filed: May 9, 2011

(65) Prior Publication Data

US 2011/0280420 A1 Nov. 17, 2011

(30) Foreign Application Priority Data

May 17, 2010 (JP) ..... 2010-113159

(51) Int. Cl.
*H04R 17/00* (2006.01)

(52) U.S. Cl.
USPC ..... 367/174

(58) Field of Classification Search
USPC ..... 367/160, 174, 140, 163
See application file for complete search history.

(56) References Cited

U.S. PATENT DOCUMENTS

| | | | | |
|---|---|---|---|---|
| 4,894,811 | A * | 1/1990 | Porzio | 367/174 |
| 5,805,529 | A * | 9/1998 | Purcell | 367/163 |
| 8,265,307 | B2 * | 9/2012 | Hama | 381/150 |
| 2011/0002484 | A1 * | 1/2011 | Hama | 381/152 |
| 2011/0075521 | A1 * | 3/2011 | Hama | 367/160 |
| 2011/0280420 | A1 * | 11/2011 | Hama | 381/186 |

FOREIGN PATENT DOCUMENTS

| | | | |
|---|---|---|---|
| JP | 62-176397 | A | 8/1987 |
| JP | 2-238799 | A | 9/1990 |
| JP | 2002345082 | A | 11/2002 |
| JP | 2009-194889 | A | 8/2009 |

OTHER PUBLICATIONS

"Kaiyo-onkyo-no-kiso-to-ouyou", Marine acoustics society of Japan. Seizando-syoten, 2004, pp. 59-60.
Japanese Office Action for JP Application No. 2010-113159 mailed on Sep. 17, 2013 with Partial English Translation.

* cited by examiner

*Primary Examiner* — Daniel Pihulic

(57) ABSTRACT

There is provided an acoustic transducer which is reduced in size and which can generate an acoustic emission having a low frequency. The acoustic transducer of the present invention includes: a plurality of bending vibration modules 7 each of which is constructed of at least one bending vibrator made of at least one plate-shaped piezoelectric vibrator and at least one vibration plate; a plurality of support members 9 each of which supports each of bending vibration modules 7; and end plates which close both end portions of the acoustic transducer. The plurality of bending vibration modules 7 are arranged in a shape of a cylinder. Each of support members 9 is extended radially from the center of bending vibration modules 7 that are arranged in a shape of a cylinder and is joined to an end portion of each of the vibration plates of bending vibration modules 7 adjacent to each other. Further, a part of support members 9 has a cutout portion formed at an end portion thereof. The end plates have open apertures 4 formed therein respectively, open aperture 4 being passed through the end plate. Open aperture 4 communicates with the other open aperture 4 via acoustic emission generation part 21 and cutout portion 20, acoustic emission generation part 21 being constructed of two adjacent support members 9 and bending vibration module 7.

8 Claims, 11 Drawing Sheets

ACOUSTIC TRANSDUCER

This application is based upon and claims the benefit of priority from Japanese patent application No. 2010-113159, filed on May 17, 2010, the disclosure of which is incorporated herein in its entirety by reference.

BACKGROUND OF THE INVENTION

1. Field of the Invention

The present invention relates to an acoustic transducer and particularly to an acoustic transducer capable of performing acoustic radiation under water.

2. Description of the Related Art

In the case of performing an underwater observation like a marine survey such as an ocean crust survey, light or a radio wave is not used but a sound wave is used. This is because the light or the radio wave is easily attenuated under water but the sound wave is hard to be attenuated even under water. Thus, an acoustic transducer using a vibrator is used as a device for generating a sound wave under water.

There are many kinds of acoustic transducers. One example of the related art is an acoustic transducer using a hollow cylindrical piezoelectric vibrator (for example, "The basis and application of marine acoustics [Kaiyo-onkyo-no-kiso-to-ouyou in Japanese]", Marine acoustics society of Japan, Seizando-syoten, 2004, pp. 58-60, in Japanese). In this acoustic transducer, a cylindrical piezoelectric vibrator has electrodes provided on the inner and outer surfaces thereof and is polarized in the direction of thickness, that is, between the inner and outer electrodes. Application of a voltage between the inside electrode and the outside electrode generates a breathing vibration, which is made by the cylindrical piezoelectric resonator uniformly transforming inwardly and outwardly in the radial direction. Sound is emitted into liquid from the side surface of the cylindrical piezoelectric vibrator by the use of this breathing vibration. In the case of employing an acoustic transducer of a free-flooded structure, the acoustic transducer emits sound from the side surface thereof and, in addition, emits sound from the inner surface to the liquid in a hollow portion thereof and further emits sound to the outside by the use of the resonance of a water column of the liquid.

Another example of the related art will be described. FIG. 1A is a schematic view of an exterior appearance of a free-flooded type acoustic transducer in which bending vibration modules are arranged in the shape of a cylinder. FIG. 1B is a schematic view of a section along A-A' in FIG. 1A. Electrodes 104 are arranged on the inner and outer surfaces of plate-shaped piezoelectric vibrator 102 and one surface of electrode 104 is bonded to a vibration plate 103. In this way, bending vibration module 101 is constructed. In the acoustic transducer of this related art, bending vibration modules 10*l* are arranged in the shape of a cylinder and adjacent bending vibration modules 101 are bonded to each other (for example, Japanese Patent Laid-Open No. 02-238799). Bending vibration module 101 has waterproof structure 110. The respective bending vibration modules 101 are repeatedly bent back and forth in the direction of thickness of bending vibration module 101 to thereby emit sound to the surrounding liquid. Further, bending vibration modules 101 emit sound by the use of the resonance of a water column of the liquid in a cylindrical space surrounded by bending vibration modules 101.

Still another example of the related art will be described. FIG. 2A is a schematic view of the exterior appearance of a barrel stave type acoustic transducer of the related art. FIG. 2B is a schematic view of a section of a bending vibration module of the acoustic transducer shown in FIG. 2A. FIG. 2C is a schematic view of the interior of the acoustic transducer shown in FIG. 2A. Although not shown in the drawing, in reality, the entire outer surface has a waterproof structure.

In the barrel stave type acoustic transducer, as shown in FIG. 2A, a plurality of bending vibration modules 101 are arranged in the shape of a cylinder, and adjacent bending vibration modules 101 are not bonded to each other but have clearance 105 formed between them. Both end portions of bending vibration module 101 are fixed to end plates 106.

Bending vibration module 101, as shown in FIG. 2B, is constructed in such a way that electrodes 104 are bonded to both surfaces of plate-shaped piezoelectric vibrator 102 and such that one surface is bonded to vibration plate 103. Further, as shown in FIG. 2C, end plates 106 are supported by support column 107 so as to prevent the interval between end plates 106 from being changed.

In an acoustic transducer that directly utilizes the vibration of a non-, free-flooded type piezoelectric vibrator (having end portions not opened), that is, a hollow cylindrical piezoelectric vibrator, it is when a resonance vibration is generated in which one wavelength of longitudinal vibration in a circumferential direction of the cylindrical piezoelectric vibrator is coincident with the length of a circumference that the best efficiency of an acoustic emission from a cylindrical piezoelectric vibrator is produced. The speed of sound transmitted through a material constructing a piezoelectric vibrator is generally fast, so that for example, a cylindrical piezoelectric vibrator having a diameter of about 10 cm generates as high a resonance frequency as 5 to 10 kHz. When the frequency is reduced, one wave length is increased. Hence, in order to generate the acoustic emission with high efficiency even in a low frequency, it is preferable to employ a cylindrical piezoelectric vibrator having a larger diameter, which results in enlarging the size of the acoustic transducer.

In the above-mentioned barrel stave type acoustic transducer, which is one example of the related art, a resonance frequency can be reduced by the use of bending vibration. However, this type of acoustic transducer presents the problems in which the clearance between bending vibration modules 101 is restrained in a waterproof structure or in which bending vibration is repressed by hydraulic pressure. Hence, it is difficult to realize this type of acoustic transducer.

Further, in the above-mentioned free-flooded type acoustic transducer, which is another example of the related art, the frequency band of the acoustic emission is widened by the use of two kinds of resonance frequencies due to the breathing vibration and by the resonance of the water column in which a resonance frequency is low. However, the water column resonance frequency is determined by the total length of the acoustic transducer. In the case where the length in the axial direction of the acoustic transducer is about 20 cm, the water column resonance frequency becomes about 1 to 2 kHz. In order to realize a lower resonance frequency than this frequency, the acoustic transducer needs to have a longer length or needs to have a resonant tube (or acoustic tube) provided. Therefore, in order to generate acoustic emission of a low frequency, the acoustic transducer needs to have a larger diameter or a longer length as frequency is reduced.

SUMMARY OF THE INVENTION

The object of the present invention is to provide an acoustic transducer capable of solving the above-mentioned problem in which it is difficult for an acoustic transducer in the related art to generate an acoustic emission having a low frequency unless the size of the transducer is increased.

The acoustic transducer of the present invention includes: a plurality of bending vibration modules each of which is constructed of at least one bending vibrator that is made of at least one plate-shaped piezoelectric vibrator and at least one vibration plate; a plurality of support members each of which supports each of the bending vibration modules; and end plates which close both end portions of the acoustic transducer. The plurality of bending vibration modules are arranged in the shape of a cylinder. Each of the support members extends radially from the center of the bending vibration modules arranged in the shape of a cylinder and is joined to an end portion of each of the vibration plates of the bending vibration modules adjacent to each other. Further, a part of the support members has a cutout portion formed in an end portion thereof. The end plates have open apertures formed therein respectively, the open aperture being passed through the end plate. The open aperture communicates with the other open aperture via an acoustic emission generation part and the cutout portion, the acoustic emission generation part being constructed of two adjacent support members and the bending vibration module.

The above and other objects, features and advantages of the present invention will become apparent from the following description with reference to the accompanying drawings which illustrate examples of the present invention.

DETAILED DESCRIPTION OF THE EXEMPLARY EMBODIMENTS

Hereinafter, the exemplary embodiments of the present invention will be described on the basis of the accompanying drawings. In this regard, a construction having the same function is denoted by the same reference number in the accompanying drawings; and the description of the construction will be omitted in some cases.

Figure 3A:
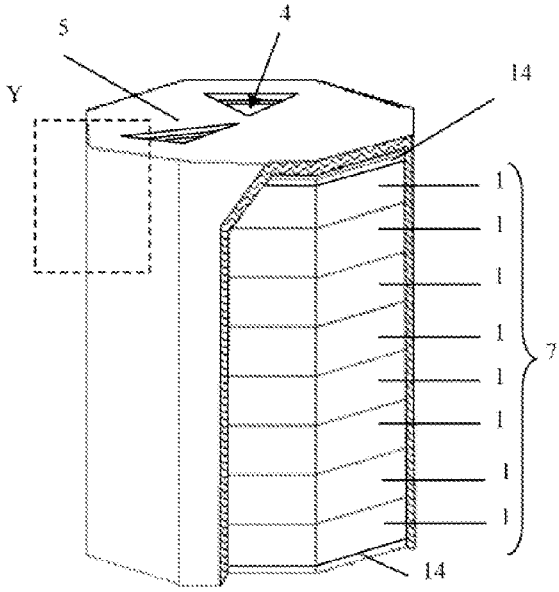
FIG. 3A is a schematic view of an exterior appearance of an exemplary embodiment of an acoustic transducer according to the present invention.
Figure 3B:
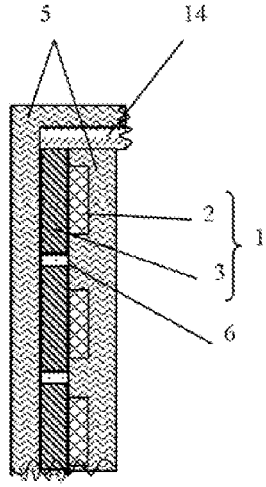
FIG. 3B is a schematic view of a section of a portion Yin FIG. 3A.
Figure 3C:
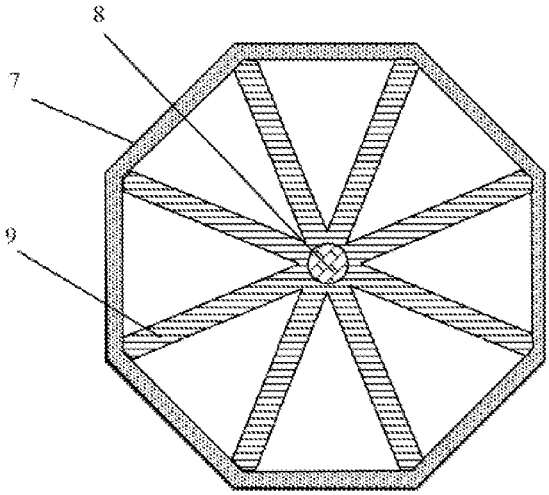
FIG. 3C is a schematic view of a section in a direction vertical to an axial direction in FIG. 3A.

FIG. 3A is a schematic view of an exterior appearance of an exemplary embodiment of an acoustic transducer according to the present invention. FIG. 3B is a schematic view of a section of portion Y in FIG. 3A. FIG. 3C is a schematic view of a section in a direction vertical to an axial direction in FIG. 3A. In the acoustic transducer of the present invention, the entire bending vibration module 7 has waterproof structure 5. However, in FIG. 3A and FIG. 3C, a portion or all of waterproof structure 5 is omitted in order to make the structure of the acoustic transducer be easily understood.

As shown in FIG. 3A, in the acoustic transducer according to the present exemplary embodiment, a plurality of bending vibrators 1 are stacked in an axial direction (that is, in an up and down direction in FIG. 3A) to thereby construct one bending vibration module 7. A plurality of bending vibration modules 7 are arranged in the shape of a cylinder. Here, bending vibration module 7 may be constructed of only one bending vibrator 1. Further, although not shown in FIG. 3A, a cushioning material 6 is provided between stacked bending vibrators 1 (see FIG. 3B). Shaft 8 is provided in the center of the cylinder formed of bending vibration modules 7. Support members 9 are provided from shaft 8 to positions where the bending vibration modules 7 are adjacent to each other (see FIG. 3C). Each of support members 9 do not need to be provided as one unit along the entire length in the axial direction of the bending vibration module 7, in other words, from the top end and to the bottom end of the portion in which the side portions of the bending vibration modules 7 are brought into contact with each other. Each of support members 9 may be provided in such a way as to be divided into a plurality of parts within a range from the top end to the bottom end of the bending vibration module 7. Further, a part of support members 9 has cutout portion 20 formed at an end portion in the axial direction.

The acoustic transducer has end plates 14 provided on its both ends in the axial direction, end plate 14 having open apertures 4 formed therein. These open apertures 4 are formed so as to pass through end plate 14, so that liquid can enter into or come out of the interior of the acoustic transducer through open apertures 4, in other words, can generate an acoustic emission.

Figure 7:
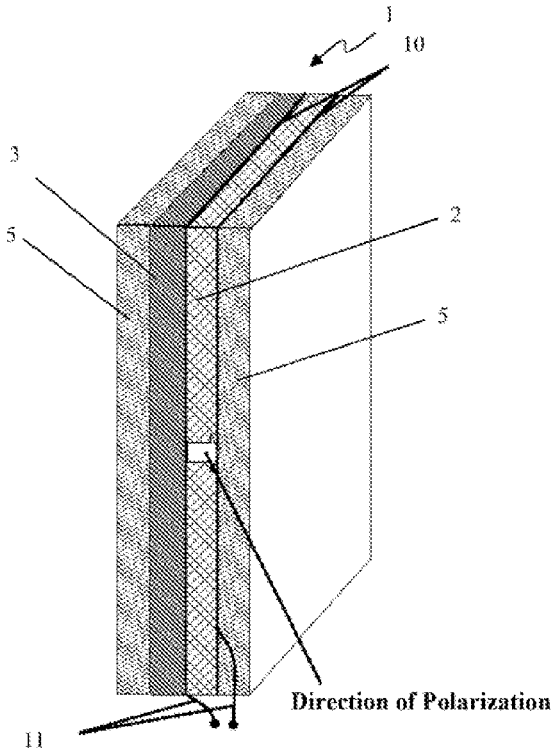
FIG. 7 is a schematic view of a bending vibrator of a unimorph structure.

Bending vibrator 1, as shown in FIG. 3B, is constructed of vibration plate 3, which is made of metal or resin, and plate-shaped piezoelectric vibrator 2 bonded to the one side of vibration plate 3 (unimorph structure, see FIG. 7). Although not shown in FIG. 3, bending vibrator 1 may be constructed of vibration plate 3, which is made of metal or resin, and plate-shaped piezoelectric vibrators 2 bonded to the both sides of vibration plate 3 (bimorph structure, see FIG. 8). Two or more bending vibrators 1 are bonded to each other directly or via a cushioning material 6 to form bending vibration module 7.

Figure 4:
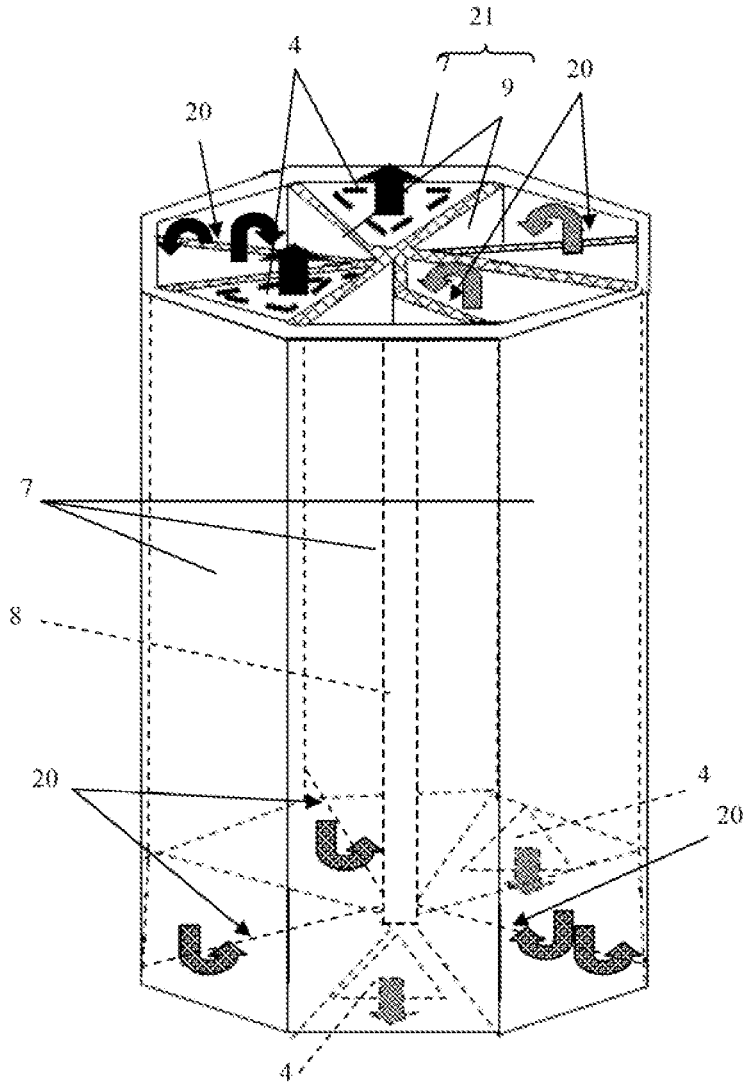
FIG. 4 is a perspective view of the acoustic transducer shown in FIG. 2A.

Here, open aperture 4 and cutout portion 20 of the present invention will be described. FIG. 4 shows a perspective view of the acoustic transducer in FIG. 3.

Assuming that a triangular column formed of one bending vibration module 7 and two support members 9 is acoustic emission generation part 21, the acoustic transducer shown in FIG. 4 includes eight acoustic emission generation parts 21. The eight acoustic emission generation parts 21 are divided into two groups in such a way that four acoustic emission generation parts 21 that are arranged successively compose one group.

First, one group composed of four acoustic emission generation parts 21 that are arranged successively will be described. Of the one group composed of the four acoustic emission generation parts 21 arranged successively, two acoustic emission generation parts 21, which are positioned on both ends in the arrangement of four acoustic emission generation parts 21 of the one group and which are not sandwiched by the other acoustic emission generation parts 21 of the one group, have open apertures 4 formed in end plate 14 on one side in the axial direction thereof (that is, in an up and down direction in FIG. 4). Support member 9 partitioning acoustic emission generation part 21, in which open aperture 4 is positioned, from the acoustic emission generation part 21 adjacent thereto has cutout portion 20 formed at an end portion on the opposite side (that is, on a bottom side in FIG. 4) of the one side in which open aperture 4 is positioned, cutout portion 20 being formed in such a way as to shorten the length of support member 9 in a longitudinal direction thereof (that is, in the up and down direction in FIG. 4). Further, support member 9 partitioning two acoustic emission generation parts 21, both of which do not have open aperture 4 positioned, from each other has cutout portion 20 formed at an end portion on the one side in which open aperture 4 is positioned, cutout portion 20 being formed in such a way as to shorten the length of support member 9 in the longitudinal direction thereof (that is, in the up and down direction in FIG. 4). In this way, a zigzag turn-back structure can be formed in which the plurality of acoustic emission generation parts 21 are made to communicate with each other at their end portions on both sides in the up and down direction in FIG. 4, which can hence form a continuous long pipe elongated from one open aperture 4 to the other open aperture 4. The other group composed of four acoustic emission generation parts 21 that are arranged successively also has open apertures 4 and cutout parts 20 formed therein in the same manner. In this case, open apertures 4 are formed in end plate 14 on the other side which is the opposite side of the one group described above. In this way, as in the case of the one group described above, a zigzag turn-back structure can be formed and hence a continuous long pipe can be formed which is elongated from one open aperture 4 to the other open aperture 4. The continuous long pipe formed in this manner can provide a water column resonance length longer than the length of the acoustic transducer.

The one example of the exemplary embodiment described above shows a case in which the number of acoustic emission generation parts 21 is eight (that is, the number of the corners of acoustic emission generation parts 21 is eight), that is, an even number. In this case, it is preferable that an even number of open apertures 4 is formed in each of the end plates 14.

On the other hand, in a case in which the number of the acoustic emission generation parts 21 is an odd number (that is, the number of the corners of the acoustic emission generation parts 21 is an odd number), one acoustic emission generation part 21 has one open aperture 4 formed in end plate 14 on one side in the up and down direction in FIG. 4. Either of two acoustic emission generation parts 21 adjacent to acoustic emission generation part 21 having the one open aperture 4 formed in end plate 14 on the one side has one open aperture 4 formed in end plate 14 on the other side. Support member 9 partitioning acoustic emission generation parts 21, each of which has open aperture 4 positioned, does not have cutout portion 20 formed therein. In order to form a continuous long pipe to make one open aperture 4 communicate with the other open aperture 4, as in the case of the one example of the exemplary embodiment described above, a plurality of support members 9 have cutout portions 20 formed alternately at their end portions on both sides in the up and down direction in FIG. 4. In this way, acoustic emission generation part 21 is made to communicate with different acoustic emission generation parts 21 on the one end and on the other end. Thus, a zigzag turn-back structure can be constructed and hence a continuous long pipe can be formed which is elongated from open aperture 4 on the one side to the other open aperture 4 on the other side. Therefore, this can provide a water column resonance length longer than the length of the acoustic transducer.

In this way, in the case where the number of acoustic emission generation parts 21 is an odd number, it is preferable that each of the end plates of the end portions on both sides of the acoustic transducer has one open aperture 4.

Figure 5A:
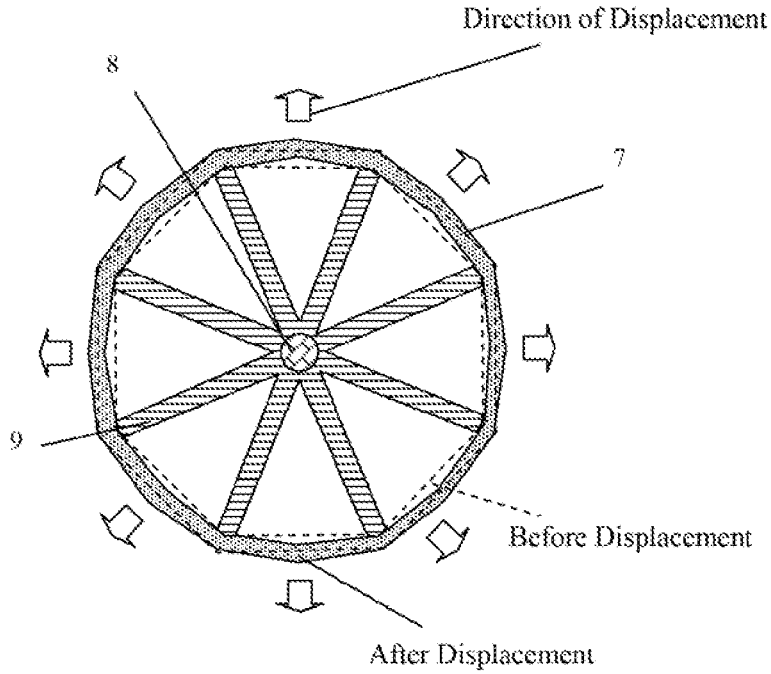
FIG. 5A is a view to illustrate a state in which the bending vibration modules of the acoustic transducer shown in FIG. 2A are displaced when the bending vibration modules have voltage applied thereto so as to be displaced outward.
Figure 5B:
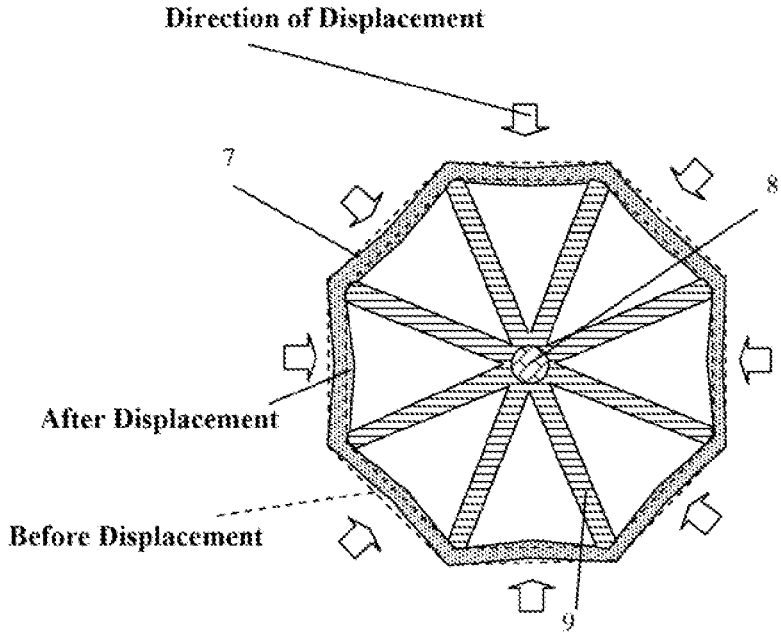
FIG. 5B is a view to illustrate the state when the bending vibration modules have voltage applied thereto so as to be displaced inward.

Next, the action of the acoustic transducer of the present exemplary embodiment will be described in detail. Support member 9 provided from shaft 8 to the joint portion of adjacent bending vibration modules 7 has a function of making the joint portion of bending vibration module 7 vibration support point of bending vibration module 7. Bending vibration module 7 is bent when voltage is applied to the plate-shaped piezoelectric vibrators 2. When electrodes 10 (see FIG. 7) to be described later are connected to each other in such a way that the direction of bending is the same as the direction of the voltage for all of the bending vibration modules 7, the whole of bending vibration modules 7 that are arranged in the shape of a cylinder are displaced outward to thereby push out liquid from the surfaces of bending vibration modules 7 to the outside (see FIG. 5A). On the other hand, when the direction of the voltage applied to plate-shaped piezoelectric vibrators 2 is reversed, bending vibration modules 7 are uniformly displaced inward and hence the liquid flows into bending vibration modules 7 from the outside (see FIG. 5B). When an AC voltage is applied to plate-shaped piezoelectric vibrators 2, bending vibration modules 7 are continuously displaced outward and inward, that is, vibrated, whereby the acoustic emission is generated from the outer surfaces of bending vibration modules 7.

Further, the liquid also flows into the pipe formed of the plurality of acoustic emission generation parts 21 connected to each other from one open aperture 4 to the other open aperture 4. Hence, when bending vibration modules 7 are vibrated, there is generated the resonance of a water column of the resonance of the liquid in the communication pipe in which the acoustic emission generation parts 21 are made to communicate with each other.

Figure 6:
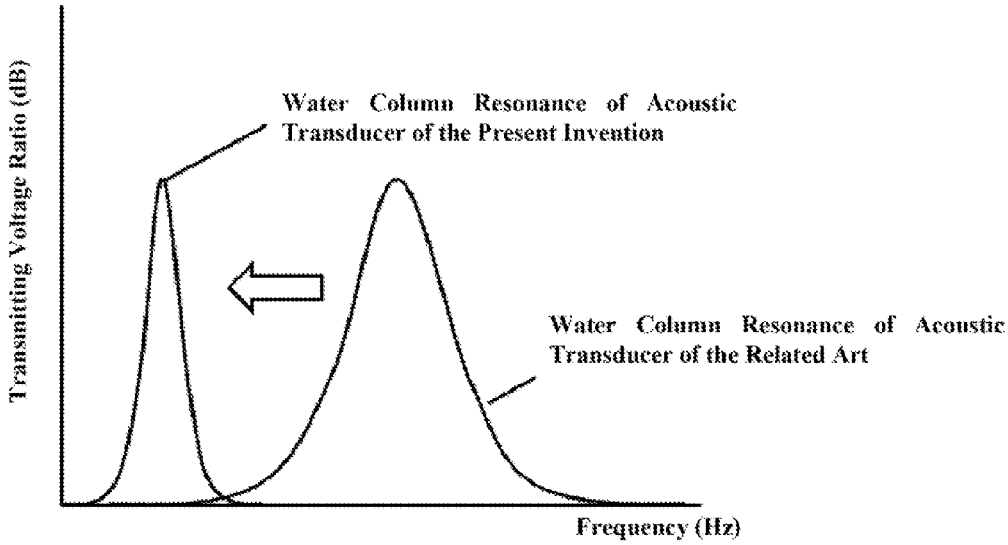
FIG. 6 is a view to show the relationship between a frequency and a transmitting voltage ratio of the resonance of water column generated in the acoustic transducer shown in FIG. 2A and the resonance of water column generated in a free-flooded type acoustic transducer of the related art in which an acoustic transducer is completely open at both ends.

In the acoustic transducer of the present invention, acoustic emission generation parts 21 are connected to each other from one open aperture 4 to the other open aperture 4, so that a water column resonance length can be made far longer than the size of the acoustic transducer without enlarging the size of the acoustic transducer or providing additional resonant tubes or the like. For this reason, as shown in FIG. 6, as compared with a free-flooded type acoustic transducer of the related art, the acoustic transducer of the present invention can provide a water column resonance having a low resonance frequency.

Further, when the resonance frequency of the bending vibration of the bending vibration module 7 is set in such a way as to be shifted from a water column resonance frequency, a frequency band of an acoustic emission in which the acoustic emission can be efficiently generated can be made wide.

Still further, when the number of acoustic emission generation parts 21 is increased (the number of the corners of the acoustic transducers is increased), the length of the water column resonance can be made longer.

In this regard, bending vibrator 1 can have various structures. The structure of bending vibrator 1 will be described in detail.

As a first exemplary embodiment of bending vibrator 1, an example of a unimorph structure is shown in FIG. 7 in which plate-shaped piezoelectric vibrator 2 is bonded to one surface of vibration plate 3 and in which electrodes 10 are provided on both surfaces of plate-shaped piezoelectric vibrator 2. Here, in the drawings from FIG. 7 to FIG. 10 to be described later, the near side in the drawing is the top side in the axial direction of the acoustic transducer, and the far side in the drawing is the bottom side in the axial direction of the acoustic transducer.

Plate-shaped piezoelectric vibrator 2 is polarized in a direction between electrodes 10, that is, in the direction of thickness thereof. When voltage is applied between these electrodes 10 from connection lines 11, plate-shaped piezoelectric vibrator 2 is vibrated in a lateral vibration mode (31 mode) in which plate-shaped piezoelectric vibrator 2 is vibrated in a width direction.

Figure 8:
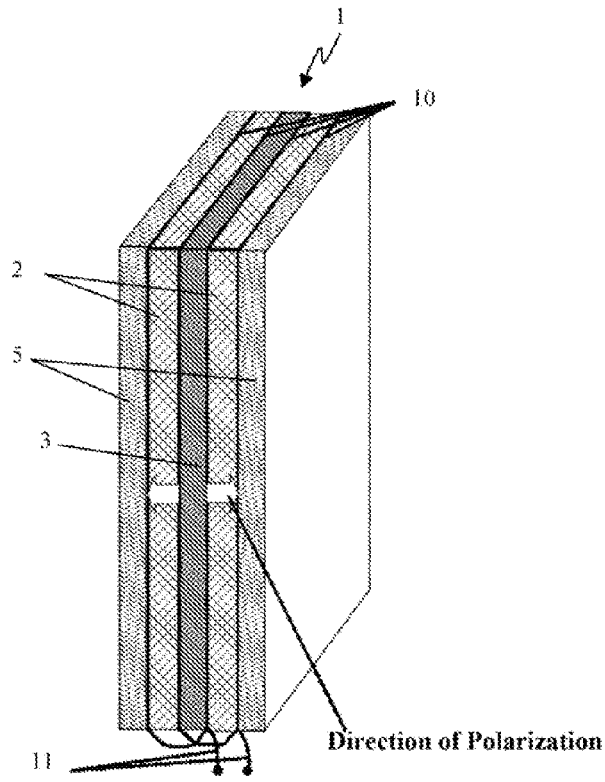
FIG. 8 is a schematic view of a bending vibrator of a bimorph structure.

As a second exemplary embodiment of bending vibrator 1, an example of a bimorph structure is shown in FIG. 8 in which plate-shaped piezoelectric vibrators 2 are bonded to both surfaces of vibration plate 3 and in which electrodes 10 are provided on both surfaces of each of the plate-shaped piezoelectric vibrators 2.

Here, plate-shaped piezoelectric vibrator 2 is polarized in the direction between electrodes 10, and that direction of polarization is symmetrical with respect to the center of the vibration plate 3. In this case, one outside electrode is connected to the other inside electrode, and one inside electrode is connected to the other outside electrode, and voltage is applied between respective connection lines 11. Although not shown here in the drawing, the direction of polarization of plate-shaped piezoelectric vibrator 2 is made unsymmetrical with respect to vibration plate 3. When the outside electrodes of two plate-shaped piezoelectric vibrators 2 are connected to each other and the inside electrodes of two plate-shaped piezoelectric vibrators 2 are connected to each other and the voltage is applied between the connection lines, the same effect can be produced.

Figure 9:
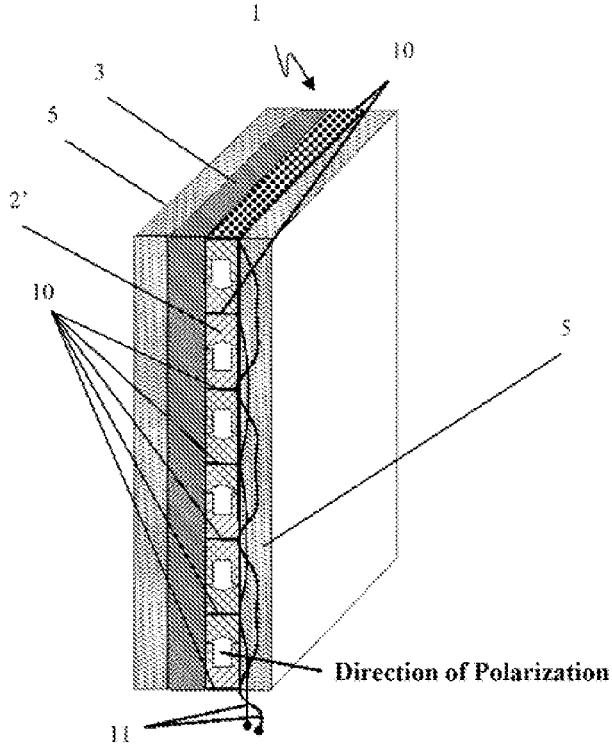
FIG. 9 is a schematic view of a bending vibrator of a unimorph structure using a plate-shaped piezoelectric vibrator stacked body.

As a third exemplary embodiment of bending vibrator 1, a structure is shown in FIG. 9 in which plate-shaped piezoelectric vibrator stacked body 2' made by stacking small piezoelectric vibrators is used as plate-shaped piezoelectric vibrator 2.

This plate-shaped piezoelectric vibrator stacked body 2' has a structure in which small plate-shaped piezoelectric vibrators are arranged in parallel with electrodes provided on their bonded surfaces. In this case, in a case where vibration plate 3 is an insulating plate, vibration plate 3 does not need to have an insulating layer, but in a case where vibration plate 3 is a conductive plate, although not shown in the drawing, vibration plate 3 needs to have an insulating layer. Here, the direction of polarization is the direction between electrodes 10, and the directions of polarization of the adjacent piezoelectric vibrators are made opposite to each other alternately. Each of electrodes 10 has voltage applied thereto via two connection lines 11 connected alternately to every other electrode 10 in accordance with the direction of polarization. The piezoelectric vibrator of this example is vibrated in a longitudinal vibration mode (33 mode) in which the direction of polarization is the same as the direction of electric potential generated between the electrodes 10 and in which the direction of expansion and contraction of the piezoelectric vibrator is the same direction.

Figure 10:
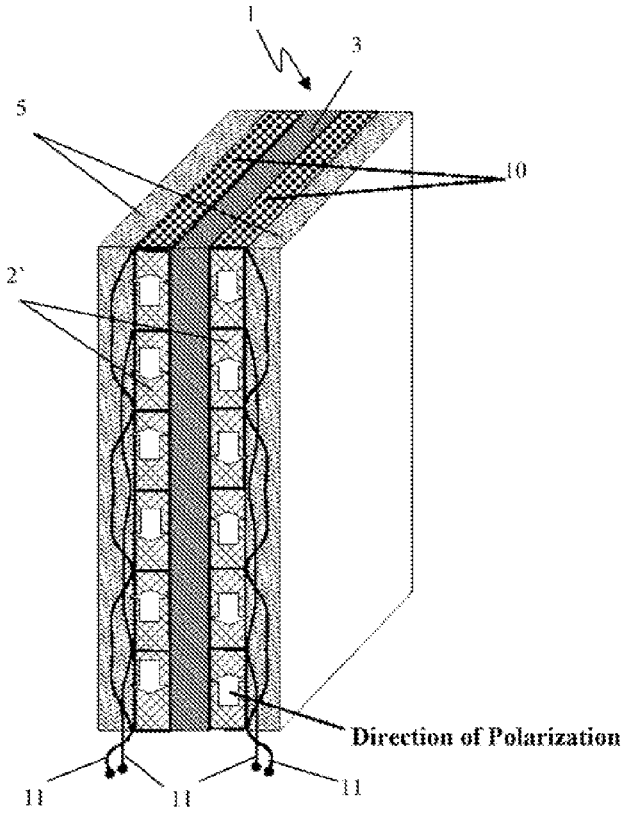
FIG. 10 is a schematic view of a bending vibrator of a bimorph structure using a plate-shaped piezoelectric vibrator stacked body.

The structure described above is a unimorph structure in which the plate-shaped piezoelectric vibrator stacked body 2' is used as plate-shaped piezoelectric vibrator 2 on one side of vibration plate 3. However, as shown in FIG. 10, even in the case where 33 mode is used, as in the case where 31 mode is used, bending vibrator 1 can be formed in the bimorph structure. The direction of polarization of piezoelectric vibrator is made opposite to the direction of polarization of piezoelectric vibrator at the opposite position across vibrator plate 3. In this way, plate-shaped piezoelectric vibrator stacked body 2' on one side is displaced in the direction of contraction, and plate-shaped piezoelectric vibrator stacked body 2' on the other side is displaced in the direction of expansion. As a result, bending vibrator 1 is deflected. Although not shown in the drawing, when the direction of polarization is made the same for piezoelectric vibrators and the direction of connection of electrode 10 is made reverse, the same effect can be produced.

Next, other exemplary embodiments of the acoustic transducer according to the present invention will be described. The exemplary embodiments are characterized in that when the resonance frequency of the bending vibration of adjacent bending vibration modules 7 is changed, the acoustic emission frequency band can be further widened in which the acoustic emission can be efficiently generated.

Figure 1A:
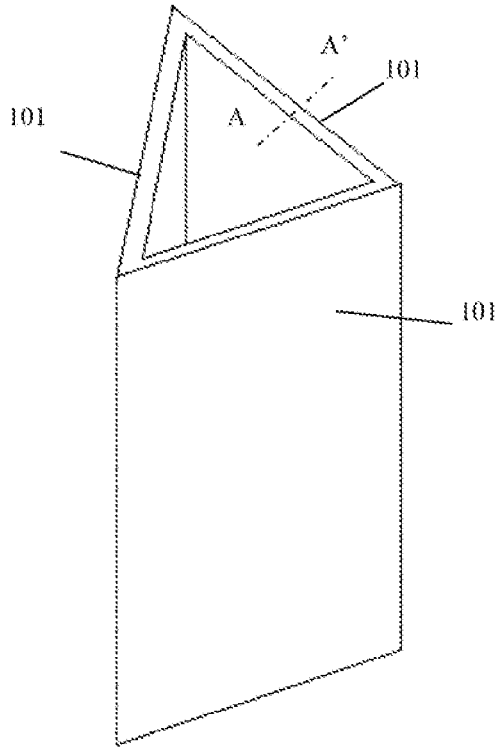
FIG. 1A is a schematic view of an exterior appearance of one example of a free-flooded type acoustic transducer of the related art, in which bending vibration modules are arranged in a shape of a cylinder.
Figure 1B:
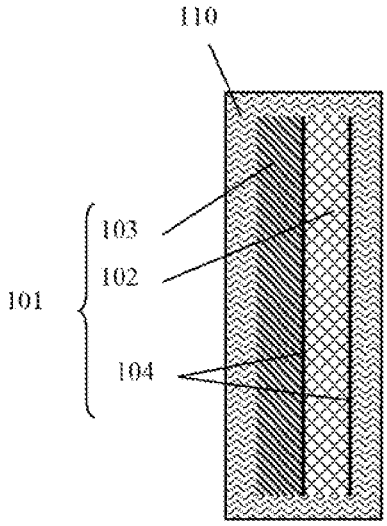
FIG. 1B is a schematic view of a section along A-A' in FIG. 1A.
Figure 2A:
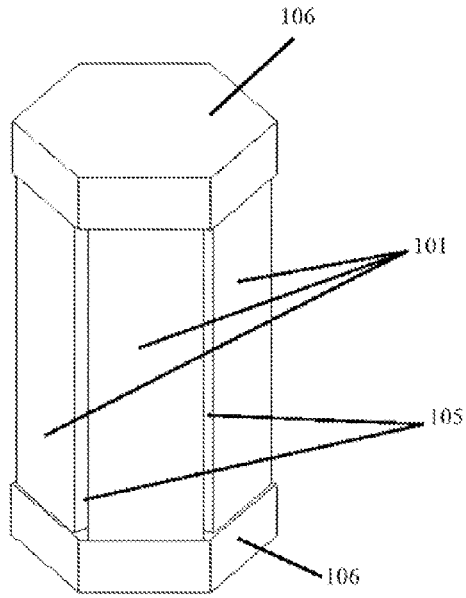
FIG. 2A is a schematic view of an exterior appearance of one example of a barrel stave type acoustic transducer of the related art.
Figure 2B:
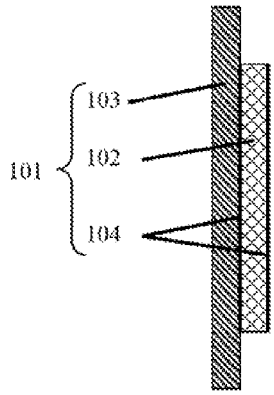
FIG. 2B is a schematic view of a section of a bending vibration module of the acoustic transducer shown in FIG. 2A.
Figure 2C:
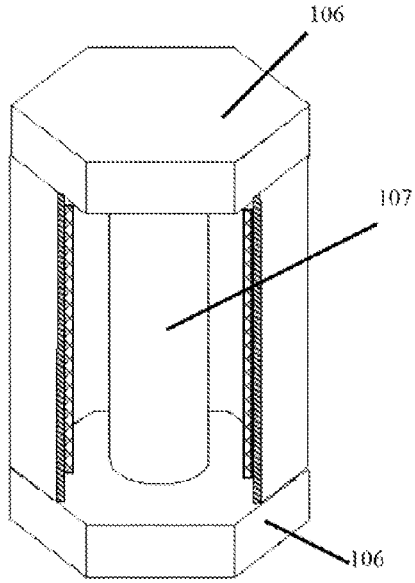
FIG. 2C is a schematic view of an interior of the acoustic transducer shown in FIG. 2A.
Figure 11:
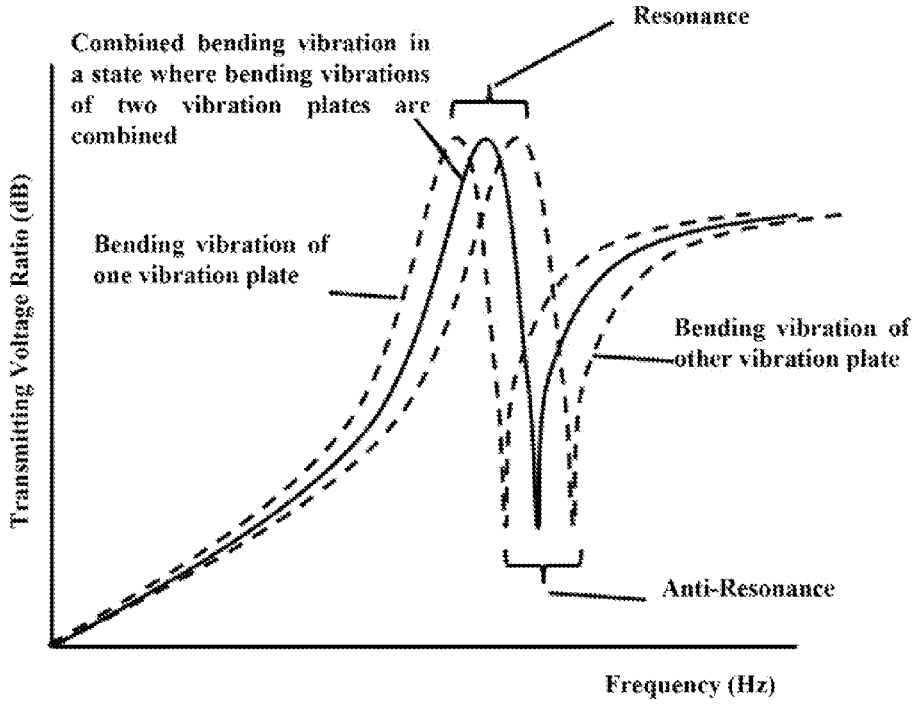
FIG. 11 is a view to show the relationship between a frequency and a transmitting voltage ratio of a bending vibration of an acoustic transducer employing a bending vibration module made of a plate-shaped piezoelectric vibrator and two vibration plates bonded to the plate-shaped piezoelectric vibrator, the two vibration plates being different from each other in thickness.

It is assumed that in a free-flooded type acoustic transducer of one example of the related art (see FIGS. 1A and 1B), a structure in which two vibration plates 103 having different thicknesses are bonded to plate-shaped piezoelectric vibrator 102 in such a way as to sandwich plate-shaped piezoelectric vibrator 102 is employed to shift the resonance frequencies of the bending vibration of respective vibration plates 103 from each other. In this case, apparently, the position of a node of vibration is moved to the center of gravity of bending vibration module 101 to generate a combination resonance, which makes it impossible to generate the acoustic emission of different resonance frequencies (see FIG. 11).

Figure 12A:
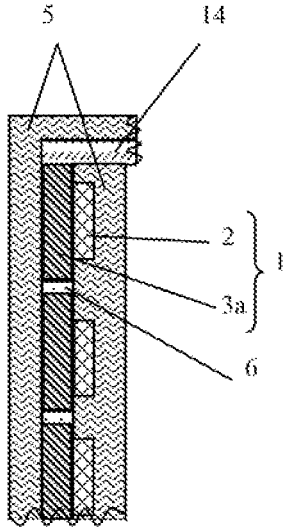
FIG. 12A is a schematic construction view of a bending vibration module having a thick vibration plate in another exemplary embodiment of the acoustic transducer according to the prevent invention.
Figure 12B:
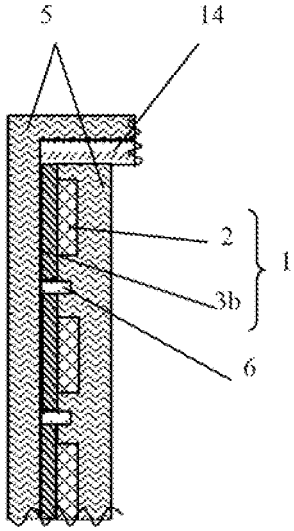
FIG. 12B is a schematic construction view of a bending vibration module having a thin vibration plate in still another exemplary embodiment of an acoustic transducer according to the prevent invention.

FIG. 12A is a schematic construction view of a bending vibration module in another exemplary embodiment of an acoustic transducer according to the present invention and illustrates a case of a bending vibration module having a thick vibration plate. FIG. 12B is a schematic construction view of a bending vibration module in still another exemplary embodiment of an acoustic transducer according to the present invention and illustrates a case of a bending vibration module having a thin vibration plate. Here, the descriptions of the same constructions as the exemplary embodiment described above will be omitted.

In this exemplary embodiment, adjacent bending vibration modules 7 are made different from each other in the resonance frequency due to the bending vibration. Specifically, of adjacent bending vibration modules 7, one bending vibration module 7 is made of thick vibration plate 3*a* (see FIG. 12A), whereas the other bending vibration module 7 is made of thin vibration plate 3*b* (see FIG. 12B). According to this construction, bending vibration module 7 that is made of the thick vibration plate 3*a* has a high resonance frequency, whereas bending vibration module 7 that is made of thin vibration plate 3*b* has a low resonance frequency.

In the acoustic transducer of this exemplary embodiment, bending vibration modules 7 are not bonded to each other but bending vibration modules 7 are fixed to support member 9. For this reason, of bending vibration module 7, a portion fixed by support member 9 is made the node of vibration, so that adjacent bending vibration modules 7 do not generate a combination resonance. Hence, the resonance frequencies of the bending vibration of respective bending vibration modules 7 can be independently set. Further, in the case of employing three or more bending vibration modules 7, when vibration plates 3 of respective bending vibration modules 7 are different from each other in thickness, three or more resonance frequencies can be also utilized.

Figure 13:
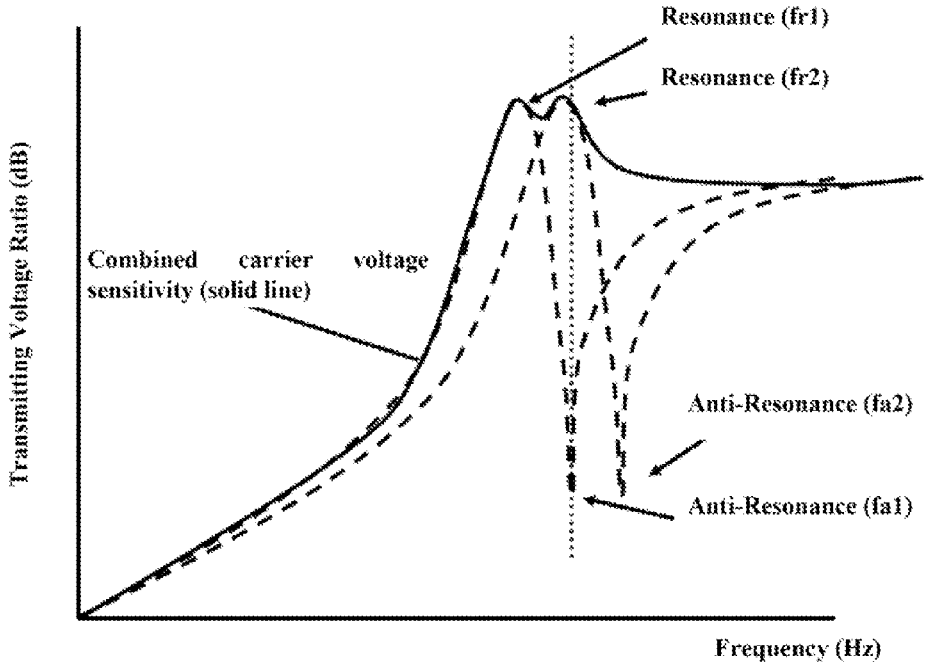
FIG. 13 is a view to show the relationship between a frequency and a transmitting voltage ratio due to a bending vibration in a case where a plurality of bending vibration modules of different resonance frequencies are used adjacently for an acoustic transducer.

It is assumed that a resonance frequency and an anti-resonance frequency in the bending vibration of one bending vibration module 7 made of thin vibration plate 3*b* are fr1 and fa1, respectively and that a resonance frequency and an anti-resonance frequency in the bending vibration of the other bending vibration module 7 made of the thick vibration plate 3*a* are fr2 and fa2, respectively. When the resonance frequency fr2 in the vibration mode of the other bending vibration module 7 is made coincident with the anti-resonance frequency fa2 in the vibration mode of one bending vibration module 7, a large drop in the carrier voltage sensitivity of the acoustic transducer caused by the anti-resonance of bending vibration module 7 can be substantially reduced (see FIG. 13).

Figure 14:
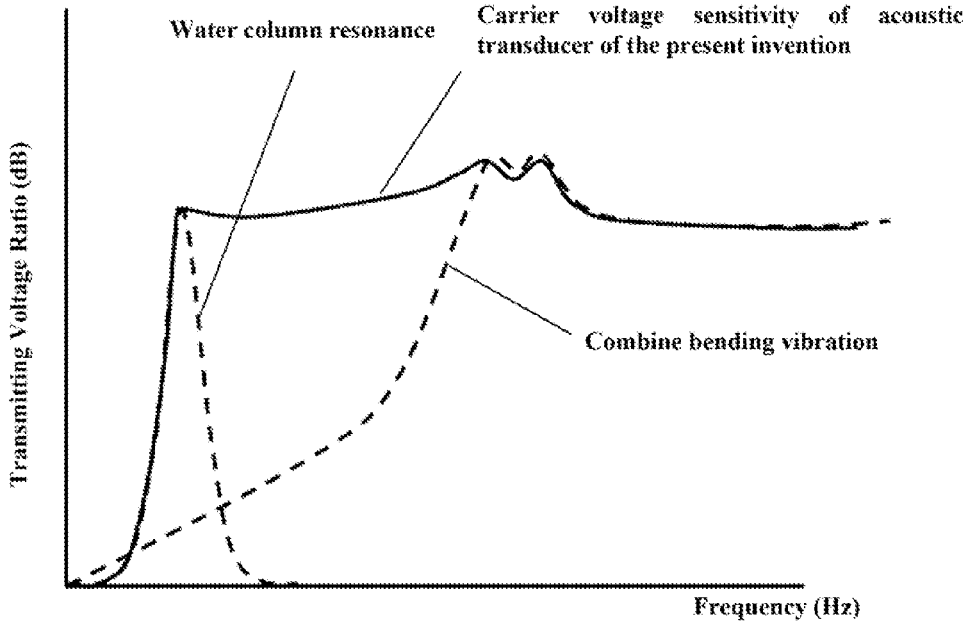
FIG. 14 is a view to show a relationship between a frequency and a transmitting voltage ratio of an acoustic transducer of the present exemplary embodiment.

For the above reason, by utilizing the water column resonance and the bending resonance generated by the bending vibrations of bending vibration modules 7 in which the resonance frequencies are shifted from each other, as shown in FIG. 14, there can be provided an acoustic transducer having a high transmitting voltage ratio over a wide frequency band.

In this way, in the acoustic transducer of the present exemplary embodiment, the resonance frequency of the bending vibration of bending vibration module 7 can be changed by changing the thickness of vibration plate 3 of bending vibration module 7. For this reason, in reality, an acoustic transducer is required to be designed within limited sizes in many cases, but since the acoustic transducer of the present invention can provide the resonance of the water column that has a low frequency without an increase in size and can set the resonance frequency of the bending vibration wide, the acoustic transducer of the present invention can increase the degree of design freedom.

Next, still another exemplary embodiment of an acoustic transducer according to the present invention will be described.

Figure 15:
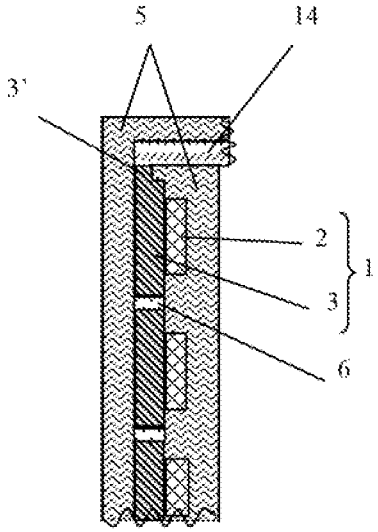
FIG. 15 is a schematic construction view of a bending vibration module in still another exemplary embodiment of the acoustic transducer according to the present invention.

FIG. 15 shows a schematic construction view of a bending vibration module in still another exemplary embodiment of an acoustic transducer according to the present invention. Here, the descriptions of the same constructions of the exemplary embodiments described above will be omitted.

Bending vibration module 7 generates a bending vibration with a node at a joint portion where bending vibration module 7 is joined to support member 9. However, both end portions of bending vibration module Tare joined to end plate 14, so that the amplitude of the bending vibration near end plate 14 of bending vibration module 7 is repressed. Therefore, vibration plate 3 of bending vibration module 7 near end plate 14 is provided with thin vibration plate portion 3' which is thinner in thickness than the other portion of vibration plate 3. Alternatively, a thin cushioning material (not shown) which is thinner in thickness than vibration plate 3 is provided between end plate 14 and vibration plate 3. These constructions can make it difficult for a force, which is caused by end plate 14 and which restrains the bending vibration of bending vibration module 7, to be transmitted to vibration plate 3. As a result, the amplitude of the bending vibration of bending vibration module 7 can be held large. Further, these constructions can reduce the bending vibration generated in bending vibration module 7 with a support point (or a node) at the joint portion of end plate 14 and bending vibration module 7.

In this regard, a piezoelectric vibrator stacked body in which piezoelectric vibrators are stacked from shaft 8 to bending vibration module 7 can be used as support member 9 of the acoustic transducer of the present invention. When voltage is applied to the piezoelectric vibrator stacked body, the piezoelectric vibrator stacked body is expanded or contracted simultaneously in a radial direction. The displacement caused by this expansion and contraction of the piezoelectric vibrator stacked body is transmitted to bending vibration module 7 to thereby vibrate bending vibration module 7, whereby the acoustic emission can be generated to the outside. In this case, not only the vibration of bending vibration module 7 itself but also the vibration of bending vibration module 7, which is excited by the expansion and contraction of the piezoelectric vibrator stacked body, is utilized. In this way, it is possible to use three resonance frequencies consisting of: the resonance frequency due to the bending vibration of the bending vibration module 7; the resonance frequency of the water column resonance; and the resonance frequency of the resonance caused by the piezoelectric vibrator stacked body that causes entire bending vibration module 7 to vibrate uniformly in the radial direction. When these three resonance frequencies are shifted little by little and the phase relationship between them is suitably set, the acoustic emission over a wide frequency band can be generated.

According to the present invention, even if the acoustic transducer is not enlarged in size, the acoustic transducer can generate an acoustic emission that has a low frequency.

While the invention has been particularly shown and described with reference to exemplary embodiments thereof, the invention is not limited to these embodiments. It will be understood by those of ordinary skill in the art that various changes in form and details may be therein without departing from the spirit and scope of the present invention as defined by the claims.

What is claimed is:

1. An acoustic transducer comprising:

a plurality of bending vibration modules which are arranged in a shape of a cylinder and each of which is constructed of at least one bending vibrator that is made of at least one plate-shaped piezoelectric vibrator and of at least one vibration plate;

a plurality of support members which extend radially from a center of the bending vibration modules arranged in a shape of a cylinder and each of which is joined to an end portion of each of the vibration plates of the bending vibration modules adjacent to each other to thereby support the bending vibration module;

end plates which close both end portions of the acoustic transducer, respectively;

a cutout portion which is formed in an end portion of a part of the support members; and open apertures each of which is formed in each of the end plates and is made to communicate with the other open aperture via an acoustic emission generation part and the cutout portion, the acoustic emission generation part being constructed of two support members adjacent to each other and the bending vibration module.

2. The acoustic transducer according to claim 1, wherein the number of the acoustic emission generation part is an even number, wherein each of the end plates has an even number of the open apertures formed therein, wherein the open aperture formed in the end plate on one side communicates with the other open aperture formed in the end plate on the one side, and wherein the open aperture formed in the end plate on another side communicates with the other open aperture formed in the end plate on the other side.

3. The acoustic transducer according to claim 1, wherein the number of the acoustic emission generation part is an odd number and one of the acoustic emission generation parts has the open aperture formed in the end plate on one side, and wherein either of the two acoustic emission generation parts adjacent to the acoustic emission generation part having the open aperture formed in the end plate on the one side has the open aperture formed in the end plate on another side.

4. The acoustic transducer according to claim 1, wherein of the bending vibration modules adjacent to each other, one bending vibration module is different as regards the thickness of the vibration plate from the other bending vibration module.

5. The acoustic transducer according to claim 1, wherein the vibration plate adjacent to the end plate of the bending vibration module has a thin vibration plate portion formed at a position close to the end plate, the thin vibration plate portion being thinner in thickness than the other position of the vibration plate.

6. A method of generating an acoustic emission, the method comprising the steps of:

making adjacent acoustic emission generation parts, each of which is constructed of one of a plurality of bending vibration modules arranged in a shape of a cylinder and two support members, communicate with each other by forming a cutout portion in the support member, each of the bending vibration modules being constructed of at least one bending vibrator made of at least one plate-shaped piezoelectric vibrator and at least one vibration plate, each of the support members extending radially from a shaft provided at a center of the bending vibration modules arranged in a shape of a cylinder and joining an end portion of the vibration plate of each of the bending vibration modules adjacent to each other to thereby support the bending vibration module, making one of the open apertures formed in end plates that close both end portions of an acoustic transducer communicate with the other of the open apertures formed in the end plate via the plurality of acoustic emission generation parts, and generating water column resonance whose water column resonance length is longer than a length of the acoustic transducer.

7. The method of generating an acoustic emission according to claim 6, wherein of the bending vibration modules adjacent to each other, one bending vibration module has a resonance frequency of bending vibration made coincident with an anti-resonance frequency of the bending vibration of the other bending vibration module.

8. The method of generating an acoustic emission according to claim 6, wherein the vibration plate adjacent to the end plate of the bending vibration module is made thinner in thickness on a portion close to the end plate than on the other portion thereof to thereby make it difficult for a force, which is caused by the end plate and which restrains bending vibration of the vibration plate, to be transmitted to the vibration plate adjacent to the end plate.

* * * * *